US007422166B2

(12) United States Patent
Hoffmann et al.

(10) Patent No.: US 7,422,166 B2
(45) Date of Patent: Sep. 9, 2008

(54) FUEL INJECTOR HAVING A SEPARABLE ARMATURE AND PINTLE

(75) Inventors: Guy Hoffmann, Sandweiler (LU); Frank A Clerx, Luxembourg (LU)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/592,026

(22) Filed: Nov. 2, 2006

(65) Prior Publication Data

US 2007/0095955 A1 May 3, 2007

(51) Int. Cl.

| | |
|---|---|
| ***F02M 61/06*** | (2006.01) |
| ***F02M 61/08*** | (2006.01) |
| ***F02M 61/20*** | (2006.01) |
| ***F02M 51/00*** | (2006.01) |
| ***B05B 1/30*** | (2006.01) |

(52) U.S. Cl. ..... 239/585.2; 239/533.7; 239/533.9; 239/585.1

(58) Field of Classification Search ..... 239/585.2, 239/533.7, 533.9, 585.1, 453, 533.2, 533.3, 239/585.3, 585.4, 585.5; 251/129.15, 129.16, 251/129.19

See application file for complete search history.

(56) References Cited

U.S. PATENT DOCUMENTS 3,450,353 A * 6/1969 Eckert ..... 239/585.2
3,623,460 A * 11/1971 Komaroff et al. ..... 123/472
4,342,443 A * 8/1982 Wakeman ..... 251/129.08
5,104,046 A * 4/1992 Sakagami ..... 239/409
5,141,164 A * 8/1992 Ohno et al. ..... 239/585.2
2004/0164175 A1* 8/2004 Maeurer et al. ..... 239/102.2

FOREIGN PATENT DOCUMENTS

GB 1197738 * 7/1970

* cited by examiner

*Primary Examiner*—Darren W Gorman
(74) *Attorney, Agent, or Firm*—Patrick M. Griffin

(57) ABSTRACT

A fuel injector comprises an injector body having a tip portion defining a spray aperture; a pintle extending within the tip portion for axial movement between an extended position and a retracted position, the pintle having a head portion engageable with the spray aperture to close the spray aperture when the pintle is in its retracted position; biasing means being provided for biasing the pintle towards its retracted position; and solenoid means for selectively moving the pintle into said extended position; said solenoid means comprising an electromagnetic coil and a moveable armature capable of being acted upon by the coil to urge the pintle towards its extended position; wherein the pintle and armature are separable from one another whereby the armature can decouple from the pintle when the pintle moves from its extended position to its retracted position.

9 Claims, 2 Drawing Sheets

FUEL INJECTOR HAVING A SEPARABLE ARMATURE AND PINTLE

TECHNICAL FIELD OF INVENTION

The present invention relates to a fuel injector and in particular to a fuel injector for direct injection of gasoline into the combustion chamber of an internal combustion engine.

BACKGROUND OF INVENTION

Modern direct injection gasoline engines require fuel injectors to operate under extreme conditions of temperature and pressure and with high fuel pressures. Furthermore, the fuel injector must open and close very rapidly in order to provide multi-pulse injection cycles required for fuel efficiency and low emissions.

Current high pressure direct injection fuel injectors either use inwardly opening valves (nozzle type or multi-hole director) in conjunction with solenoid actuation or outwardly opening valves using piezo-electric actuation. The outwardly opening piezo-electric actuated injector has demonstrated the highest potential for reducing fuel consumption, but the cost of the piezo-stack and driver is prohibitive for high volume applications.

Known outwardly opening piezo-electric actuated fuel injectors generally comprise a valve body having a tip portion defining a spray aperture, a pintle or valve stem extending within the tip portion for axial movement between an extended and a retracted position, the pintle having an external head engageable with a valve seat of the spray aperture to close the spray aperture when the pintle is in its retracted position, a return spring biasing the pintle towards its retracted position, an actuating means in the form of a piezo-stack, acting upon the pintle to urge the pintle to its extended position when the piezo-stack is energised.

The piezo-stack can provide a high opening force to overcome the strong return spring required to hold the valve closed and the high hydraulic forces generated during the high pressure operation of the injector. The piezo-stack also provides rapid valve opening and can achieve a variable valve lift. However, piezo-electric fuel injectors are very costly to produce compared to solenoid actuated injectors and require complex and costly control systems for operation of the piezo-stack.

By contrast, solenoid actuated fuel injectors are much cheaper to produce. However, known solenoid actuated fuel injectors cannot provide the same level of performance as piezo-electric actuated devices, mainly due to the lower opening force achievable by electromagnetic solenoid actuators and the slower rise of force over time.

A particular problem with known outwardly opening solenoid actuated fuel injectors when operated at high speed is valve bounce. When closing the injector at high speed, the impact of the pintle head against the valve seat can be substantial due to the large mass of the armature connected to the pintle and the force exerted on the pintle by the return spring. Due to the elasticity of the valve surfaces and the pintle stem, the pintle head tends to rebound from the valve seat, causing the injector to re-open. Such valve bounce can cause one or more unmetered after injections of fuel delivery after injector closing. This problem is particularly acute in high pressure applications.

Known outwardly opening solenoid actuated fuel injectors utilise squeeze film damping to attempt to eliminate valve bounce by carefully controlling the air gap between the armature and the facing surfaces above and below the armature when the pintle is in its retracted and extended positions. Such gaps are required to be controlled to around 20 μm or less with slight variations leading to substantial variations in squeeze damping effect. Manufacturing and adjusting such air gaps has proven to be very expensive and difficult to control, with additional problems of durability and performance, particularly in relation to differential thermal expansion of different parts of the injector during use. Squeeze film damping forces are essentially proportional to the cube of the distance between squeeze damping surfaces and their relative velocity. Due to this highly non-linear nature, squeeze damping gaps need to be very well controlled in order to limit part by part variations in a mass produced injector. GB1197738 discloses a known injector disclosing an armature decoupled from the valve pintle.

SUMMARY OF THE INVENTION

An object of the present invention is to provide a solenoid actuated fuel injector that achieves the same performance as a piezo-electric actuated device.

According to the present invention there is provided a fuel injector for an internal combustion engine, the injector comprising an injector body having a tip portion defining a spray aperture; a pintle extending within the tip portion for axial movement between an open or extended position and a closed or retracted position, the pintle having a head portion engageable with the spray aperture to close the spray aperture when the pintle is in its retracted position; biasing means being provided for biasing the pintle towards its retracted position; and solenoid means for selectively moving the pintle into said extended position; said solenoid means comprising an electromagnetic coil and a moveable armature capable of being acted upon by the coil to urge the pintle towards its extended position; wherein the pintle and armature are separable from one another whereby the armature can decouple from the pintle when the pintle moves from its extended position to its retracted position, wherein a stop is provided for defining the extended position of the pintle, whereby a minimum lower air gap exists between armature and the injector housing/electromagnetic coil when the armature is in its operative position and the pintle is in its extended position to avoid the generation of squeeze film damping between the armature and adjacent surfaces when the armature is in its operative position. Preferably the minimum lower air gap is at least 20 μm. More preferably the minimum lower air gap is at least 40 μm.

Preferably the armature is moveable between an operative position, wherein the armature engages the pintle and holds the pintle in its extended position, and an inoperative position wherein the armature is spaced from the pintle. Preferably an axial gap of at least 20 μm, more preferably at least 40 μm, exists between the pintle and the armature when the armature is in its inoperative position and the pintle is in its retracted position.

By decoupling the armature from the pintle, the use of squeeze film damping gaps that are not hard stops is avoided, thus avoiding the need to carefully control such gaps during manufacture. The minimum upper air gap between the armature and an upper stop is always zero because, due to decoupling of the armature from the pintle, the armature always continues to travel to the upper stop after the pintle has reached its closed or retracted position. Because of the separation of the mass of the armature from the pintle, the inertia of the pintle is greatly reduced, the risk of after-injections due to valve bounce at injector closing is alleviated.

In order to further reduce the risk of valve bounce during opening of the injector, a small amount of fluid shear damping may be introduced by controlling the radial gap between at least a portion of the pintle and/or the armature and a surrounding portion of the injector body and/or solenoid. Alternatively, or additionally, a controlled frictional force may be introduced by means of a friction member, such as a radially biased pin, abutting a side surface of the pintle and/or the armature.

In one embodiment of the present invention the armature is biased towards its inoperative position whereby the armature is spaced from the pintle when the pintle is in its retracted position and the electromagnetic coil is de-energised.

In an alternative embodiment the armature is biased towards its operative position in order to urge the armature into contact with the pintle at all times.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

The present invention will now be described, by way of example, with reference to the accompanying drawings, in which.

DETAILED DESCRIPTION OF INVENTION

Figure 1:
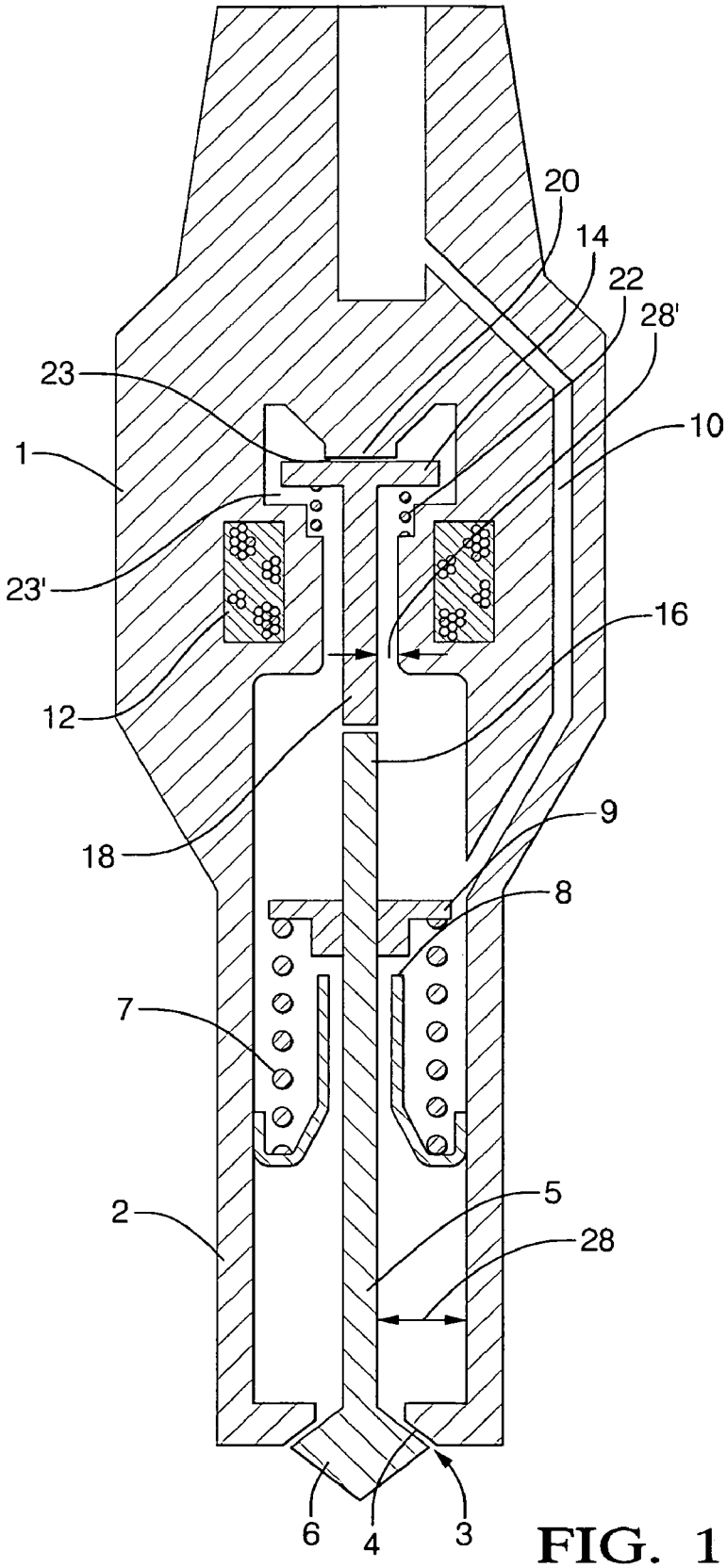
FIG. 1 is a sectional view of a fuel injector according to a first embodiment of the present invention.

A fuel injector according to a first embodiment of the present invention is shown in FIG. 1. The fuel injector comprises an injector body 1 having a tip portion 2 having a spray aperture 3 at a distal end thereof. An outwardly opening valve pintle 5 extends within the tip portion 2, the pintle 5 having a head portion 6 engageable with a valve seat 4 surrounding the spray aperture 3 to close the spray aperture 3.

The pintle 5 is axially moveable within the injector body 1 between a retracted position wherein the head portion 6 engages the valve seat 4 and an extended position wherein the head portion 6 is spaced from the valve seat 4. A return spring 7 is mounted within the tip portion, biasing the pintle 5 towards its retracted position. An end stop 8 mounted on the injector housing 1 cooperates with a collar 9 on the pintle to limit the extension of the pintle 5 and define the extended position of the pintle 5.

The interior of the tip portion 2 of the injector body 1 communicates with an inlet port of the injector body by means of a fuel supply passageway 10 whereby high pressure fuel can be supplied to the interior of the injector body 1 upstream of the spray aperture 3.

A solenoid actuator, comprising an electromagnetic coil 12 and a moveable armature 14 capable of being acted upon by the coil 12, is provided within the injector housing 1 and is arranged to be operable to urge the pintle 5 to its extended position.

A distal end 16 of the pintle 5, remote from the head portion 6, is engageable by a portion 18 of the armature 14 to urge the pintle to its extended position when the electromagnetic coil 12 is energised to open the injector, said distal end 16 of the pintle 5 being separable from said portion 18 of the armature 14 whereby the armature 14 can decouple from the pintle 5 when the pintle 5 moves from its extended to its retracted position during injector closing.

The present invention avoids valve bounce upon injector closing by decoupling the armature 14 from the pintle 5 such that the armature 14 separates from the pintle 5 and continues moving towards an upper stop 20 when the head portion 6 of the pintle 5 abuts the valve seat 4 as the injector closes (i.e. as the pintle 5 moves to its retracted position). Thus the inertia of the armature 14 upon injector closing has no effect on the head portion 6 of the pintle 5 and the impact force of the head portion 6 on the valve seat 4 is reduced. Therefore valve bounce can be avoided without requiring the use of squeeze film damping and the resultant need for careful control of the upper air gap 23 of the armature 14.

To further reduce the risk of valve bounce during opening of the injector, a small amount of fluid shear damping may be introduced by controlling the radial gap 28 between at least a portion of the pintle 5 and a surrounding portion of the injector body 1. The radial gap 28' between at least a portion of the armature 18 and a surrounding portion of the solenoid 12 may also be controlled. Alternatively, or additionally, a controlled frictional force may be introduced by means of a friction member 30, such as a radially biased pin, abutting a side surface of the pintle 5 and/or the armature 18.

In order to avoid gap dependent squeeze film damping effects, the end stop 8 is arranged to provide a minimum lower air gap 23' of at least 20 μm between armature 14 and the injector housing/electromagnetic coil 12 when the solenoid is energised and the pintle 5 is in its extended position. Preferably the end stop 8 is arranged to provide a minimum lower air gap 23' of at least 40 μm.

In the embodiment shown in FIG. 1, an armature return spring 22 is provided between the armature 14 and the coil 12 to urge the armature 14 towards its upper stop 20 to maintain a zero upper air gap 23 when the solenoid is de-energised.

By providing an air gap between the armature 14 and the pintle 5 when the solenoid is de-energised and the injector is closed, the initial force required to be exerted by the solenoid to move the head portion 6 of the pintle 5 away from the valve seat 4 to open the injector is reduced because the armature 14 is able to pick up speed as it closes such air gap without also needing to move the pintle 5, the gained momentum of the armature 14 then assisting in the initial movement of pintle 5 as the armature 14 impacts the pintle 5.

Such arrangement also enables calibration of the injector performance to vary the amount of fuel delivered for a given solenoid actuation pulse duration without needing to vary the strength of the main return spring 7. Such calibration can be achieved by either varying the air gap between the pintle 5 and armature 14, because such air gap provides an opening delay due to the time taken to move the armature 14 to a position where it abuts the pintle 5, the larger the air gap the longer this delay. Alternatively such calibration can be achieved by adjusting the upward biasing force of the armature return spring 22.

Figure 2:
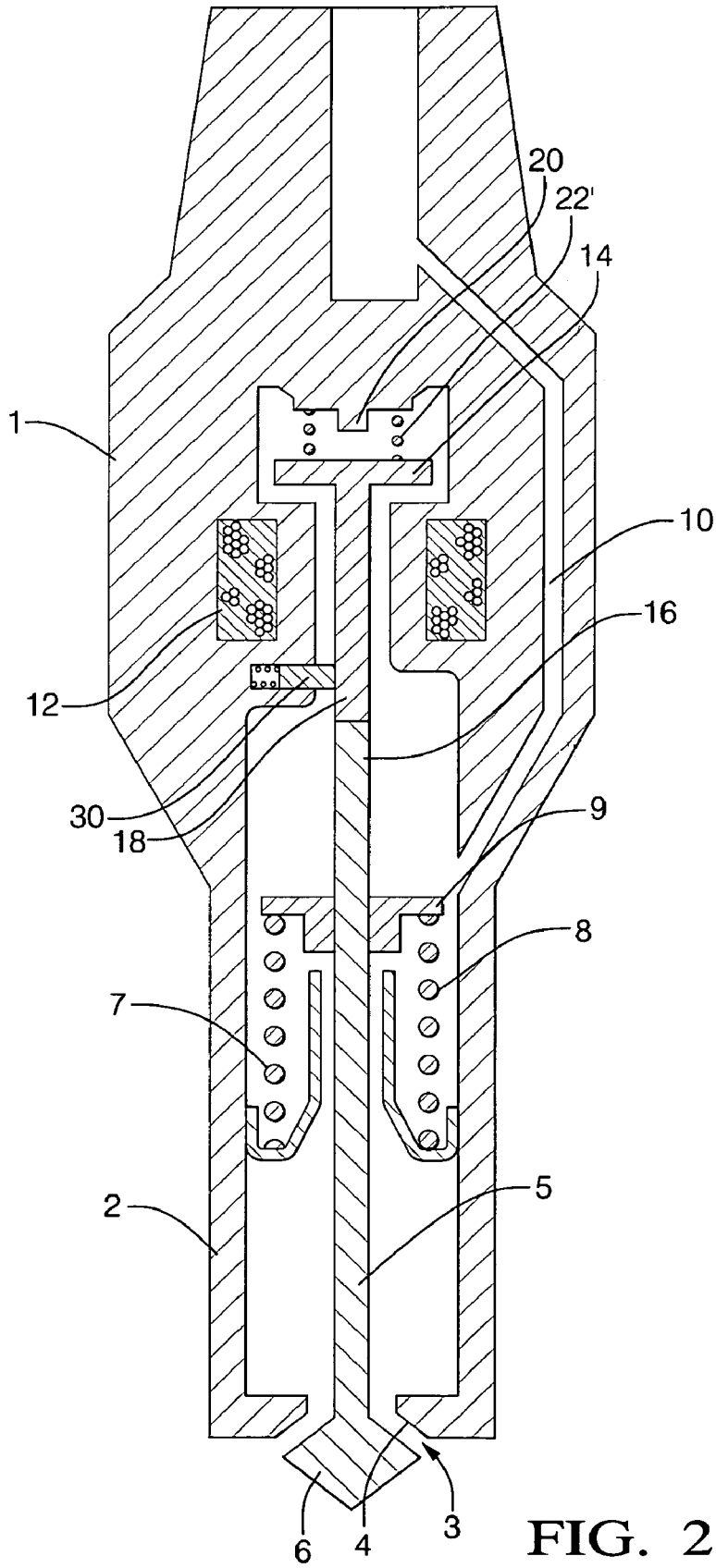
FIG. 2 is a sectional view of a fuel injector according to a second embodiment of the present invention.

In a second embodiment, shown in FIG. 2, the armature return spring 22' is provided between the armature 14 and the upper stop 20 to bias the armature 14 into contact with the pintle 5. In such embodiment, the armature return spring 22' can be selected to calibrate the injector, such spring acting against the main return spring 7 to provide a force acting on the pintle 5 in a valve opening direction.

In an alternative embodiment (not shown) the armature may be upwardly biased away from the pintle, as in the embodiment shown in FIG. 1. However, instead of locating the armature return spring between the housing and the armature—as shown in FIG. 1—the armature return spring may act between the pintle 5 and the lower portion 18 of the armature 14, such that the return spring is referenced to the pintle 5 rather than the housing 1. By locating the armature return spring adjacent the pintle 5, an upward bias is provided that does not reduce the available armature magnetic force.

While this invention has been described in terms of the preferred embodiments thereof, it is not intended to be so limited, but rather only to the extent set forth in the claims that follow.

We claim:

1. A fuel injector for an internal combustion engine, the injector comprising an injector body having a tip portion defining a spray aperture; a pintle extending within the tip portion for axial movement between an extended position and a retracted position, the pintle having a head portion engageable with the spray aperture to close the spray aperture when the pintle is in its retracted position; biasing means being provided for biasing the pintle towards its retracted position; and solenoid means for selectively moving the pintle into said extended position; said solenoid means comprising an electromagnetic coil and a moveable armature capable of being acted upon by the coil to urge the pintle towards its extended position; wherein the pintle and armature are separable from one another whereby the armature can decouple from the pintle when the pintle moves from its extended position to its retracted position;

wherein the armature is moveable between an operative position, wherein the armature engages the pintle and holds the pintle in its extended position, and an inoperative position wherein the armature is spaced from the pintle;

wherein a stop is provided against which a portion of the pintle abuts to define the extended position of the pintle, whereby a minimum lower air gap exists between the armature and the injector housing and electromagnetic coil when the armature is in its operative position and the pintle is in its extended position, such gap being of sufficient size to avoid the generation of squeeze film damping between the armature and adjacent surfaces when the armature is in its operative position.

2. A fuel injector as claimed in claim 1, wherein an axial gap of at least 20 μm exists between the pintle and the armature when the armature is in its inoperative position and the pintle is in its retracted position.

3. A fuel injector as claimed in claim 1, wherein an axial gap of at least 50 μm exists between the pintle and the armature when the armature is in its inoperative position and the pintle is in its retracted position.

4. A fuel injector as claimed in claim 1, wherein the minimum lower air gap is at least 20 m.

5. A fuel injector as claimed in claim 1, wherein the armature is biased towards its inoperative position whereby the armature is spaced from the pintle when the pintle is in its retracted position and the electromagnetic coil is de-energised.

6. A fuel injector as claimed in claim 1, further comprising a first radial gap between a portion of said pintle and surrounding portion of the injector body, and a second radial gap between a portion of said armature and said solenoid, wherein at least one of said radial gaps is controlled to provide a predetermined level of fluid shear damping.

7. A fuel injector as claimed in claim 1, wherein friction means are provide within the injector body, said friction means radially abutting at least one of said pintle and armature to control pintle movement.

8. A fuel injector as claimed in claim 1, wherein the minimum lower air gap is at least 40 μm.

9. A fuel injector for an internal combustion engine, the injector comprising an injector body having a tip portion defining a spray aperture; a pintle extending within the tip portion for axial movement between an extended position and a retracted position, the pintle having a head portion engageable with the spray aperture to close the spray aperture when the pintle is in its retracted position; biasing means being provided for biasing the pintle towards its retracted position; and solenoid means for selectively moving the pintle into said extended position; said solenoid means comprising an electromagnetic coil and a moveable armature capable of being acted upon by the coil to urge the pintle towards its extended position; wherein the pintle and armature are separable from one another whereby the armature can decouple from the pintle when the pintle moves from its extended position to its retracted position;

wherein the armature is moveable between an operative position, wherein the armature engages the pintle and holds the pintle in its extended position, and an inoperative position wherein the armature is spaced from the pintle; and wherein the armature is biased towards its operative position in order to urge the armature into contact with the pintle.

* * * * *